US008695125B2

(12) United States Patent
Funari et al.

(10) Patent No.: US 8,695,125 B2
(45) Date of Patent: Apr. 15, 2014

(54) AUTOMATIC ACTUATOR TO FLUSH TOILET

(75) Inventors: Michael A. Funari, Apex, NC (US); Jeffrey T. Phillips, Sanford, NC (US); Brian Vanhoy, Vass, NC (US); Roy F. Leviner, III, Aberdeen, NC (US)

(73) Assignee: Zurn Industries, LLC, Erie, PA (US)

( * ) Notice: Subject to any disclaimer, the term of this patent is extended or adjusted under 35 U.S.C. 154(b) by 1001 days.

(21) Appl. No.: 11/789,034

(22) Filed: Apr. 23, 2007

(65) Prior Publication Data

US 2008/0072369 A1 Mar. 27, 2008

Related U.S. Application Data

(60) Provisional application No. 60/793,916, filed on Apr. 21, 2006.

(51) Int. Cl.
*E03D 5/10* (2006.01)

(52) U.S. Cl.
USPC ..... 4/406; 4/304; 251/129.04

(58) Field of Classification Search
USPC ..... 4/405, 406, 304
See application file for complete search history.

(56) References Cited

U.S. PATENT DOCUMENTS 602,494 A * 4/1898 Briggs ..... 4/626
3,471,868 A 10/1969 Zorn
3,482,268 A 12/1969 Teshima
4,141,091 A 2/1979 Pulvari
4,225,986 A 10/1980 Mauk
4,307,923 A * 12/1981 Raz ..... 312/237
4,338,690 A 7/1982 Hsieh et al.
4,392,260 A 7/1983 Bensen
4,485,501 A 12/1984 Kloner
4,575,880 A 3/1986 Burgess
4,707,867 A 11/1987 Kawabe et al.
4,941,215 A 7/1990 Liu
5,003,643 A * 4/1991 Chung ..... 4/313
5,036,553 A 8/1991 Sanderson
5,187,816 A 2/1993 Chiou
5,187,818 A 2/1993 Barrett, Sr. et al.
5,228,146 A * 7/1993 Martell ..... 4/406
5,313,674 A 5/1994 Chiang et al.
5,400,446 A * 3/1995 Bloemer et al. ..... 4/408
5,448,784 A 9/1995 Smiley
5,455,971 A 10/1995 Sakakibara et al.
5,469,586 A 11/1995 Tsutsui et al.
5,482,250 A 1/1996 Kodaira
5,548,119 A * 8/1996 Nortier ..... 250/341.1
5,603,127 A 2/1997 Veal
5,855,027 A 1/1999 Macedo (Continued)

*Primary Examiner* — Tuan N Nguyen
*Assistant Examiner* — Erin Deery
(74) *Attorney, Agent, or Firm* — The Webb Law Firm

(57) ABSTRACT

An automatic toilet flushing system, for use with conventional toilets, includes a sensor, an actuator and a flushing mechanism. The actuator has a gear train, a motor, a pivotal arm connected to the gear train, and a power source connected to the motor for rotating the shaft of the motor which rotates the gear train for pivotal movement of the arm. The flushing mechanism includes a flapper valve and the pivotal arm is connected to the flapper valve via a bead chain and a handle swivel or a tab mounted on the pivotal arm. The sensor may replace the flush handle or the flush handle and the sensor may both be provided. A kit and a method for converting a manual flushing system to the automatic toilet flushing system are also provided.

31 Claims, 7 Drawing Sheets

(56) References Cited

U.S. PATENT DOCUMENTS

| | | | |
|---|---|---|---|
| 5,901,384 | A | 5/1999 | Sim |
| 5,950,983 | A | 9/1999 | Jahrling |
| 6,056,261 | A | 5/2000 | Aparicio et al. |
| 6,161,814 | A | 12/2000 | Jahrling |
| 6,202,227 | B1 | 3/2001 | Gurowitz |
| 6,206,340 | B1 | 3/2001 | Paese et al. |
| 6,212,697 | B1 | 4/2001 | Parsons et al. |
| 6,237,165 | B1 | 5/2001 | Chen et al. |
| 6,263,519 | B1 | 7/2001 | Parsons et al. |
| 6,499,152 | B2 | 12/2002 | Johnson |
| 6,513,787 | B1 | 2/2003 | Jeromson et al. |
| 6,560,790 | B2 | 5/2003 | Saar et al. |
| 6,568,655 | B2 | 5/2003 | Paese et al. |
| 6,598,245 | B2 | 7/2003 | Nishioka |
| 6,618,864 | B2 | 9/2003 | Veal |
| 6,619,614 | B2 | 9/2003 | Parsons et al. |
| 6,860,282 | B2 | 3/2005 | Guler |
| 2002/0029412 | A1 | 3/2002 | Veal |
| 2002/0092090 | A1 | 7/2002 | Johnson |
| 2002/0162166 | A1 | 11/2002 | Saar et al. |
| 2003/0019022 | A1 | 1/2003 | Wilson et al. |
| 2003/0074725 | A1 | 4/2003 | Pino |
| 2003/0102448 | A1 | 6/2003 | Parsons |
| 2003/0102449 | A1 | 6/2003 | Parsons et al. |
| 2003/0102450 | A1 | 6/2003 | Parsons et al. |
| 2003/0116736 | A1 | 6/2003 | Muderlak |
| 2004/0040079 | A1 | 3/2004 | Snyder |
| 2004/0068784 | A1 | 4/2004 | Muderlak |
| 2004/0154087 | A1 | 8/2004 | Hogues, Jr. |
| 2005/0076425 | A1* | 4/2005 | Contadini ..... 4/405 |
| 2006/0277674 | A1 | 12/2006 | Oakes, Jr. |
| 2008/0196151 | A1 | 8/2008 | Oakes Jr. |

* cited by examiner

AUTOMATIC ACTUATOR TO FLUSH TOILET

CROSS REFERENCE TO RELATED APPLICATION

This application is based on Provisional Patent Application No. 60/793,916 filed Apr. 21, 2006, on which priority of this patent application is based, and which is hereby incorporated by reference in its entirety.

BACKGROUND OF THE INVENTION

1. Field of the Invention

The present invention relates generally to automatic toilet flushing systems and, more particularly, to an automatic actuator for flushing toilets, such as home toilets or other toilets found in private dwellings or facilities.

2. Description of Related Art

There are many commercially available automatic toilet flushing systems for use in various commercial and industrial establishments. Also, automatic toilet flushing systems for use in conventional home toilets or other toilets found in private dwellings have been disclosed, for example, in U.S. Pat. No. 4,141,091 to Pulvari; U.S. Pat. No. 5,003,643 to Chung; and U.S. Pat. No. 6,202,227 to Gurowitz. These prior art automatic flushing systems for conventional toilet flushing systems are desirable for a variety of reasons, for example, sanitary considerations by one not having to touch a handle used by others. Also, people suffering from temporary or permanent disabilities may find it difficult to access a toilet flush handle, which is usually located rearwardly of the toilet seat. In other cases, forgetfulness or non-attentiveness of individuals may prevent them from manually flushing the toilet. In these and other situations, an automatic toilet flushing system for private dwelling structures may provide a significant advantage.

In the prior art automatic toilet flushing systems, converting a conventional toilet to one capable of automatic flushing after use can oftentimes be difficult and relatively expensive, such as requiring new or substituted toilet fixtures. A conventional toilet may be defined as a toilet which generally has a manually operated handle for flushing the toilet. Therefore, there is a need to provide an automatic toilet flushing system that is easy to install on conventional toilets while using the existing toilet fixtures including the existing toilet components, for example, the toilet bowl and reservoir tank for holding water that may constitute a conventional or standard toilet.

SUMMARY OF THE INVENTION

The present invention has met this need. More particularly, the invention provides an automatic toilet flushing system for a toilet having a reservoir tank and a toilet bowl, the system comprising a sensor for sensing the approach and departure motion of a user with respect to the toilet and for generating a signal representative of the approach and departure motion of the user; an actuator in communication with the sensor for causing an automatic flushing of the toilet in response to the signal from the sensor, the actuator having a driven pivotal arm; and a flushing mechanism co-acting with the actuator, the flushing mechanism includes a flapper valve adapted to release water from the reservoir tank, and the pivotal arm of the actuator being connected to the flapper valve for operation of the flapper valve upon the pivotal movement of the pivotal arm.

In an embodiment of the invention, the actuator is a mechanical actuator and has a gear train, a motor with an output shaft rotatably connected to the gear train, a pivotal arm having a shaft rotatably connected to the gear train and a power source for activating the motor and rotating the output shaft of the motor which, in turn, rotates the gear train for pivotal movement of the shaft of the pivotal arm, and therefore, pivotal movement of the pivotal arm. The flushing mechanism includes a flapper valve for releasing water out of the reservoir tank and into the toilet bowl, and the pivotal arm is connected to the flapper valve for operation of the flapper valve upon the pivotal movement of the shaft connected to the pivotal arm.

The actuator may be housed in an actuator box that has a first compartment for supporting the power source, for example, a battery or a battery pack, a second compartment for supporting the gear train and the motor, a first cover for covering the first compartment, a second cover for covering the second compartment, a first sealing member inserted between the first cover and the first compartment for sealing the first compartment, and a second sealing member inserted between the second cover and the second compartment for sealing the second compartment.

The actuator box has an opening in the sidewall of the second compartment, and the shaft connected to the pivotal arm of the actuator extends through the opening in the sidewall of the second compartment for supporting the pivotal arm outside of the actuator box. The pivotal arm may be connected to the flapper valve via a handle swivel connected at the end of the pivotal arm and a connector member, e.g. a chain attached to the handle swivel and the flapper valve or via a tab connected at the end of the pivotal arm and a connector member, e.g., a chain attached to the tab and to the flapper valve.

The sensor senses the approach and departure motion of a user with respect to the toilet and in an embodiment of the invention includes a housing having a body that defines a first section and a second section. The first section has a first closed end, a second open end, and first and second openings. The first opening has a signal generating source for transmitting a signal, and the second opening has a signal detector for receiving the transmitted signal from the signal generating source in the first opening thereby detecting the presence of a user of the toilet.

The second section of the housing of the sensor is secured to the second open end of the first section of the body. The second section includes an extended member that defines a center passageway and that is configured to be mounted in an opening in a sidewall of the reservoir tank of the toilet, which opening generally receives a handle for manual flushing of a conventional toilet. An electrical wire or connection extends through the center passageway of the extended member for electrically connecting the sensor to the motor located in the actuator box. Therefore, in this embodiment, only one flushing mechanism is provided and this is the automatic toilet flushing system of the invention.

In a further embodiment of the invention, the sensor may have a rectangular-shaped or a disc-shaped housing with a window, and the housing may be mounted in close proximity to the reservoir tank with the actuator mounted in the reservoir tank. The sensor and the actuator are electronically connected. A manually operated flushing handle is provided in the opening in the reservoir tank and is connected to the flapper valve preferably via a chain for the manual flushing of the toilet. This chain may be the same chain in which the pivotal arm of the sensor is connected or this chain may be a second chain. In this embodiment, the toilet may be flushed either by manually operating the handle provided in a conventional toilet or through operation of the automatic toilet flushing system of the invention.

The sensor and the actuator are preferably electrically connected via an electrical wire or wiring system. The sensor arrangement may be electronically operated through one or more technologies including infrared technology, radio frequency technology, magnetic technology, electrostatic technology, ultrasonic technology, and electromagnetic technology or a combination of these technologies. For example, the sensor arrangement may include light generating sources and light sensors that may be based on infrared radiation technology. The actuator in a preferred embodiment includes a motor and a power source; however, the actuator may also include components that function through magnetic technology and/or electromagnetic technology.

A still further embodiment of the invention involves a kit for converting a manually operated toilet flushing system into an automatic toilet flushing system in a toilet having a reservoir tank and a toilet bowl. The kit includes a sensor for sensing the approach and departure motion of a user with respect to the toilet and for generating a signal representative of the approach and departure motion of the user; an actuator in communication with the sensor for causing an automatic flushing of the toilet in response to the signal from the sensor, the actuator having a driven pivotal arm; and a flushing mechanism co-acting with the actuator. The flushing mechanism includes a flapper valve adapted to release water from the reservoir tank, and the pivotal arm of the actuator is connected to the flapper valve for operation of the flapper valve upon the pivotal movement of the pivotal arm. This kit may also include a handle swivel which can be attached to the pivotal arm and a chain which is connected to the pivotal arm and the flapper valve for operation of the flapper valve upon pivotal movement of the arm, and/or the kit may include a tap instead of a handle swivel.

A still further embodiment of the invention involves a method of converting a manual toilet flushing system into an automatic toilet flushing system. The steps include providing a sensor for sensing the approach and departure motion of a user with respect to the toilet and for generating a signal representative of the approach and departure motion of the user; providing an actuator in communication with the sensor for causing an automatic flushing of the toilet in response to the signal from the sensor, the actuator having a driven pivotal arm; and providing a flushing mechanism co-acting with the actuator, wherein the flushing mechanism includes a flapper valve adapted to release water from the reservoir tank, and wherein the pivotal arm of the actuator is connected to the flapper valve for operation of the flapper valve upon the pivotal movement of the pivotal arm.

It is therefore an object of the invention to provide an automatic toilet flushing system for a conventional toilet having a reservoir tank and a toilet bowl, wherein the actuator is easily installed inside the reservoir tank under the cover for the tank, and wherein the sensor can easily replace a toilet flushing handle or wherein the flushing handle can be provided and optionally used instead of the actuator for the automatic flushing of the toilet.

These and other objects and advantages of the present invention will be better appreciated and understood by those skilled in the art from the following description and appended claims. It is to be understood, however, that the drawings are for the purpose of illustration and description only and are not intended as a definition of the limits of the invention.

DETAILED DESCRIPTION OF THE INVENTION

Figure 1:
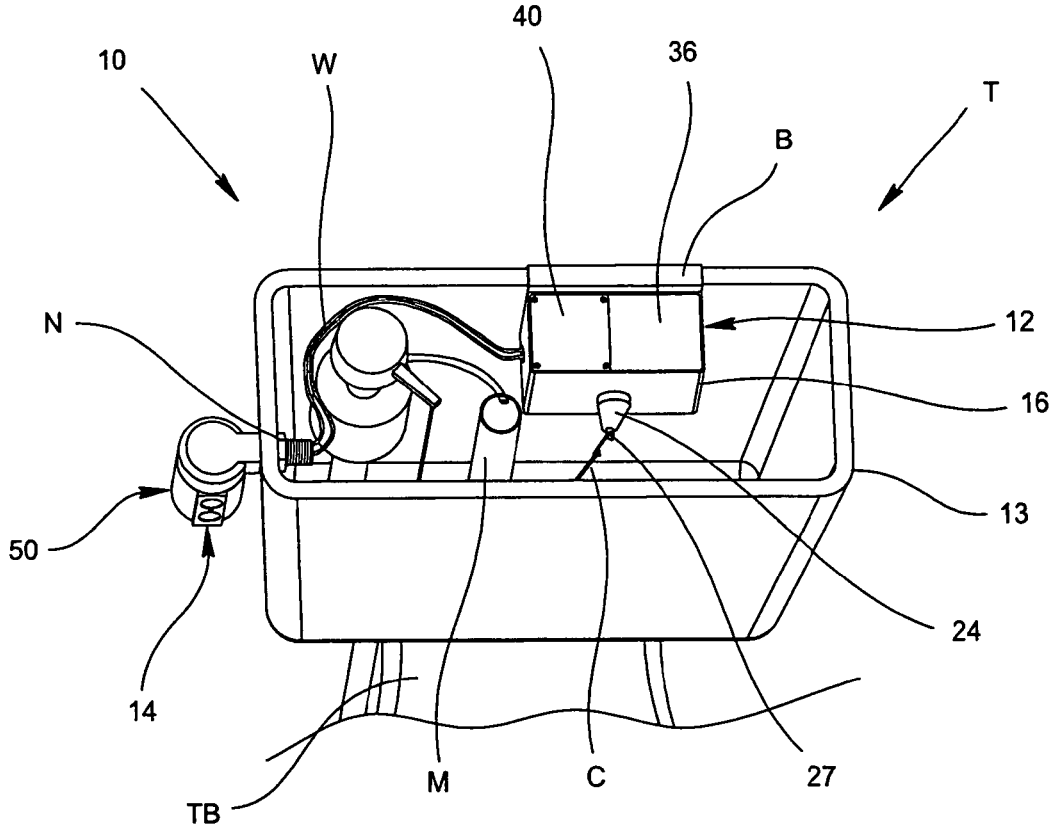
FIG. 1 a top perspective view of a first embodiment of an automatic toilet flushing system made in accordance with the present invention and showing a sensor arrangement and an actuator housed in an actuator box installed in a reservoir tank of a conventional toilet.
Figure 2:
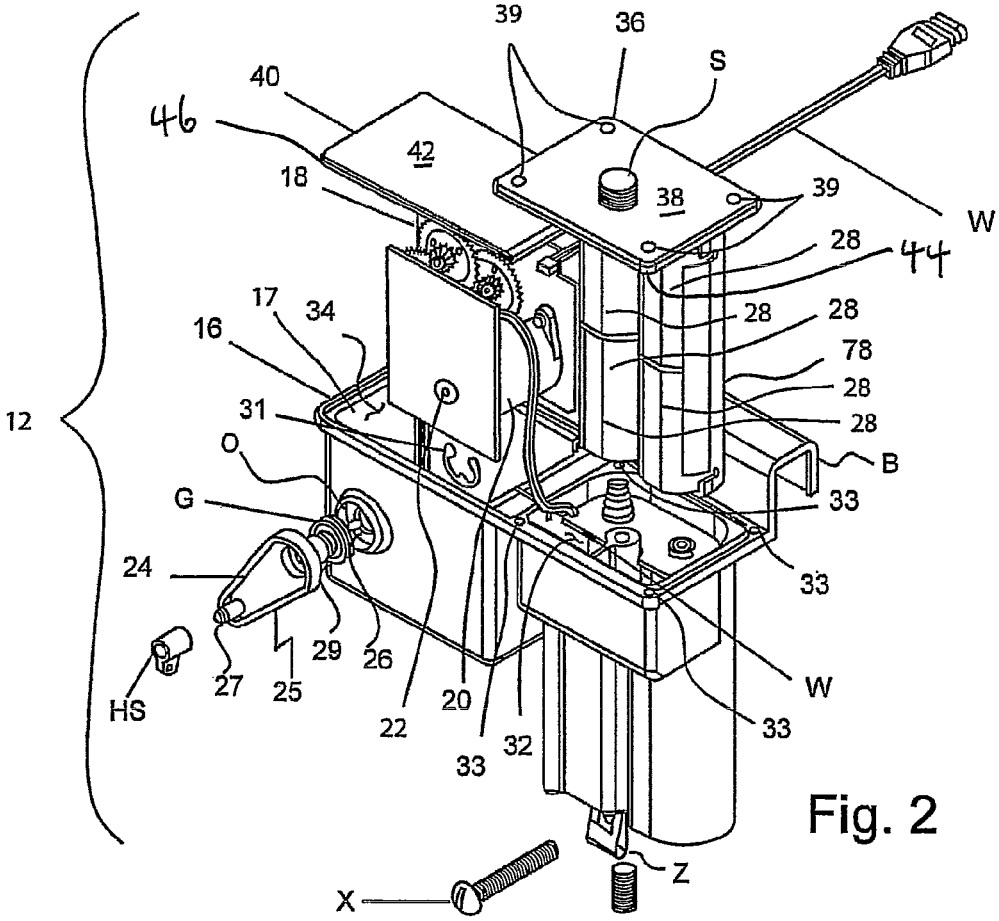
FIG. 2 is an exploded front perspective view of an actuator shown in FIG. 1.

Referring to FIG. 1, the invention provides a first embodiment of an automatic toilet flushing system 10 for a conventional toilet T which has a toilet bowl TB and a reservoir tank 13. The automatic toilet flushing system 10 includes an actuator 12 mounted in the reservoir tank 13 and in communication with a sensor 14, which is mounted into a sidewall of the conventional toilet T. The sensor 14 may be in communication with the actuator 12 via a wire W or via a transmitted signal (i.e., wireless communication). In the wireless communication arrangement, a radio frequency transmitter can be provided in the sensor 14 and a corresponding radio frequency receiver may be provided in the actuator 12. Referring to FIG. 2, the actuator 12 is housed in an actuator box 16 and includes a gear train 18, a motor 20 having an output shaft 22, and an external rotating arm 24 having a shaft 26. The output shaft 22 of the motor 20 is rotatably connected to the gear train 18, and the external arm 24 is rotatably connected to the gear train 18 via shaft 26. A power source, such as a battery 28, is electrically connected to the motor 20. For wireless communication, a signal transmission receiver (not shown) in communication with both the sensor 14 and the motor 20 may be used to receive transmitted signals from the sensor 14, thus activating and/or deactivating the motor 20. It is conceivable that the power could be provided via an electric line from an external power source coupled directly to the battery 28.

Figure 3:
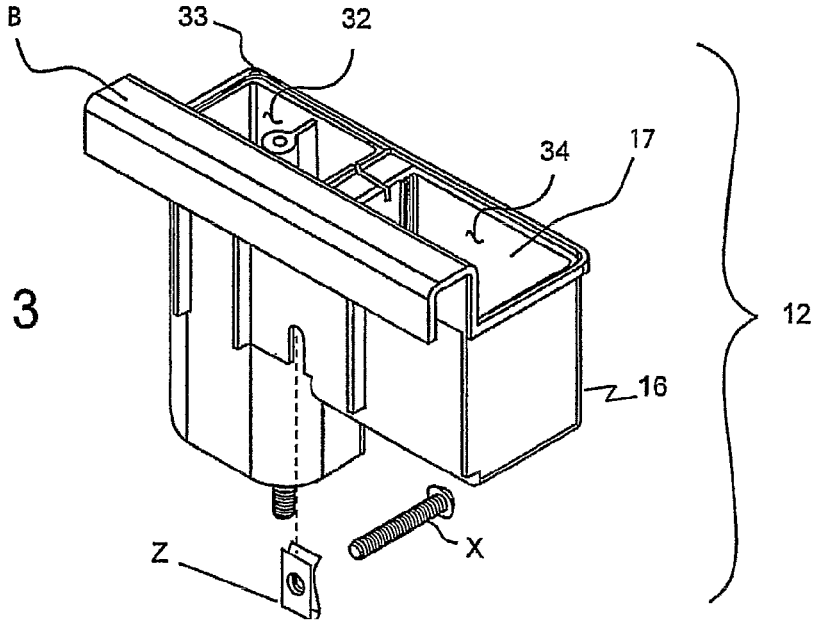
FIG. 3 is a rear perspective view of an actuator box shown in FIG. 2.

FIGS. 2 and 3 show the actuator box 16 of the automatic flushing system 10 having an open end 17 defining a first compartment 32 and a second compartment 34. As shown in FIG. 2, the first compartment 32 of the actuator box 16 can be used to house the battery 28 and a signal transmission receiver for wireless communication (not shown), and the second compartment 34 can be used to house the gear train 18 and the motor 20. Referring to FIGS. 2 and 3, the open end 17 of the first compartment 32 of the actuator box 16 defines a plurality of holes 33 adapted to receive fasteners. The actuator box 16 is preferably made of a unitary piece of molded plastic so as to be resistant to water and chemicals normally present in a toilet/bathroom environment.

Referring particularly to FIG. 2, the external arm 24 is pivotably mounted on the outside of the actuator box 16, wherein the shaft 26 of the external arm 24 extends through an opening O in a sidewall of the actuator box 16, thus connecting the external arm 24 to the gear train 18. When the motor 20 is activated, the output shaft 22 of the motor 20 rotates the gear train 18, thereby pivotably rotating the external arm 24.

Referring again to FIG. 2, a first cover 36 having a body 38 and defining a plurality of slots 39 is used to cover the first compartment 32 of the actuator box 16. The first cover 36 can be attached to the open end 17 of the first compartment 32 of the actuator box 16 via a fastener (not shown) passing through slot 39 defined in the cover body 38 of cover 36 and hole 33 defined in the actuator box 16. The first compartment 32 and the first cover 36 fully enclose the power source.

Still referring to FIG. 2, a second cover 40 having a body 42 may be used to cover the second compartment 34 of the actuator box 16. The second cover 40 is preferably sealed to the open end 17 of the second compartment 34 of the actuator box 16 by sonic welding. A gasket, such as an O-ring 46, can be inserted between the cover 40 and the open end 17 of the actuator box 16 to seal the compartment 34, thus preventing moisture from entering. The second compartment 34 and the second cover 40 fully enclose the gear train 18 and the motor 20.

Still referring to FIG. 2, the gear train 18 is used to rotate the external arm 24 of the actuator 12. The external arm 24 includes a body 25, wherein the shaft 26 is defined at one end of the body 25 and extends therefrom, and a tab 27 is defined at an opposite end of the body 25 and extends in a direction opposite that of the shaft 26. The shaft 26 of the body 25 of the external arm 24 is keyed to the gear train 18, and the tab 27 of the body 25 of the external arm 24 is connected to a flapper valve 76 via a bead chain C as particularly shown in FIG. 4. A handle swivel HS co-acting with the tab 27 can also be used to connect the external arm 24 to the flapper valve 76 (shown in FIG. 4). A sealing arrangement 29 is defined between the shaft 26 and the body 25 of the external arm 24 in order to pivotably attach the external arm 24 to the actuator box 16. A gasket, such as an O-ring (not shown) or cup seal G, may be used to seal the opening in the actuator box 16 around the shaft 26 of the external arm 24, thus preventing moisture from entering the actuator box 16. A clip 31, such as an E-clip defined in the second compartment 34, may also be used to secure the external arm 24 to the outside of the actuator box 16.

Still referring to FIG. 2, the actuator 12 includes a battery tray 78 which supports several batteries 28 in first compartment 32. The batteries 28 may be disposable or rechargeable. Referring again to FIG. 2, the first cover 36 of the first compartment 32 includes a thumb screw S used in conjunction with a gasket 44 to seal the first compartment 32. A stabilizing arrangement, such as the use of a clip, screw and knurled insert represented by elements X and Z can be used to further secure the actuator 12 to the tank reservoir 13 as shown in FIGS. 2 and 3.

Figure 5:
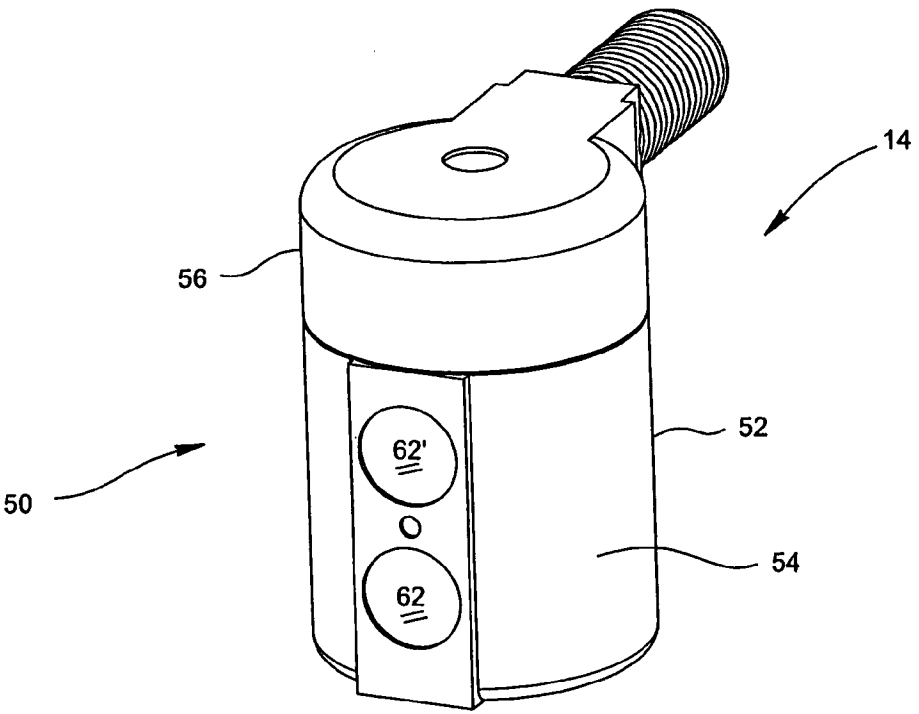
FIG. 5 is an enlarged perspective view of the sensor arrangement for the automatic flushing system shown in FIG. 1.

FIG. 5 shows the sensor 14 of the automatic flushing system 10 used to detect when a human body comes within a predetermined distance with respect to a toilet bowl (not shown). The sensor 14 is preferably located in the manual flush handle hole of a conventional toilet, thus replacing the manual flush handle as shown in FIG. 1. However, the sensor 14 can be located anywhere in the bathroom as long as it can detect a person at the toilet, more about which will be discussed relative to the second embodiment of the invention of FIG. 8. The sensor 14 preferably uses ultrasound technology to detect a user near the toilet. By using ultrasound technology, false detection due to moisture, such as steam, is eliminated. Also, ultrasound technology is not sensitive to color and can operate in all shades of light. The sensor 14 can also utilize magnetic, electrostatic, optical and electromagnetic principles for detection of a person in the vicinity of the sensor 14. Other types of sensors may be used, such as heat sensors and infrared sensors.

Figure 6A:
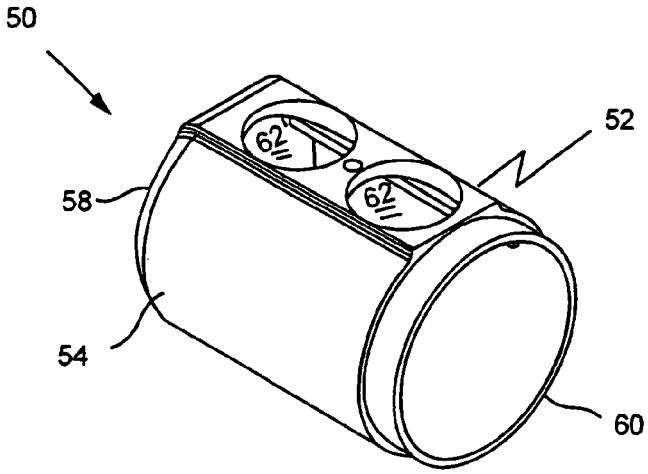
FIG. 6*a* is a perspective view of a first section of a sensor housing of the sensor arrangement shown in FIG. 5.
Figure 6B:
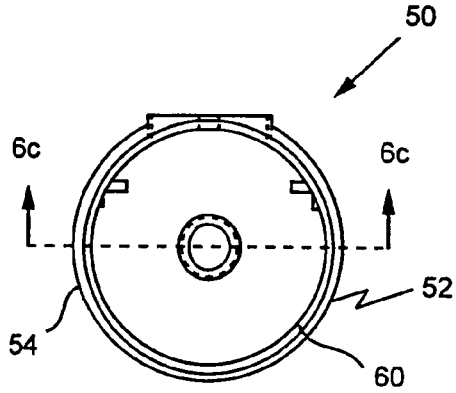
FIG. 6*b* is a bottom view of the first section of a sensor housing of the arrangement shown in FIG. 6*a;*
Figure 6C:
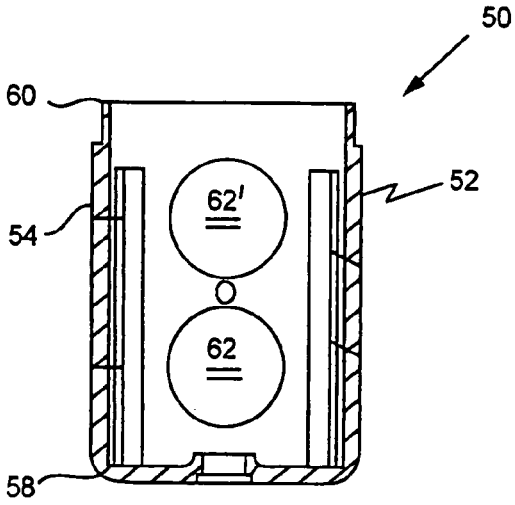
FIG. 6*c* is a sectional view taken along lines 6*c*-6*c* of FIG. 6*b;*
Figure 7A:
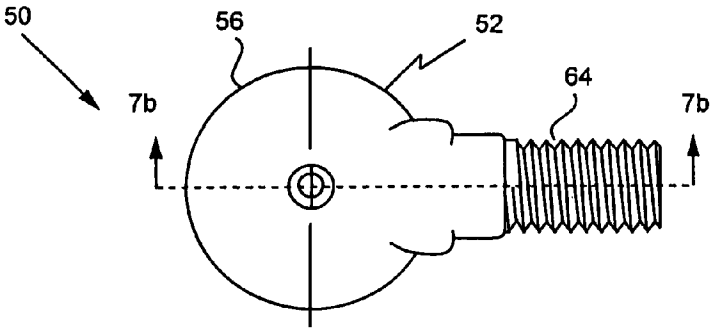
FIG. 7*a* is a top elevation view of a second section of the sensor housing of the sensor arrangement shown in FIG. 5.
Figure 7B:
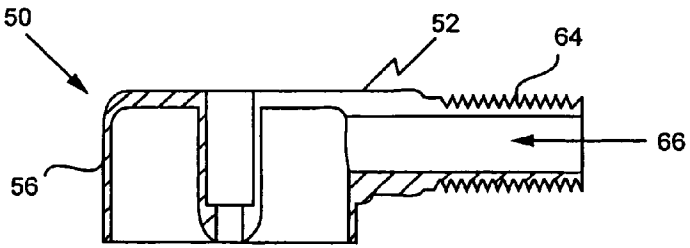
FIG. 7*b* is a sectional view taken along lines 7*b*-7*b* of FIG. 7*a;*
Figure 7C:
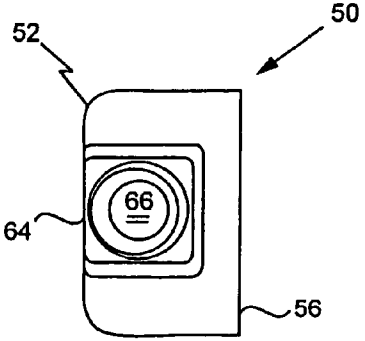
FIG. 7*c* is a side view of the second section of the sensor housing of FIG. 7*a;*
Figure 7D:
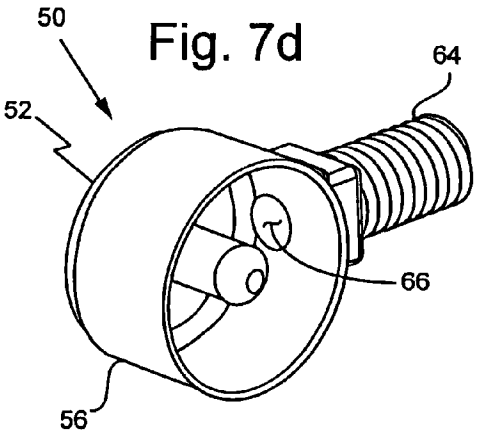
FIG. 7*d* is a perspective bottom view of the second section of the sensor housing of FIG. 7*a*.

FIGS. 6*a*-6*c* and 7*a*-7*d* show a sensor housing 50 having a body 52 and defining a first section 54 and a second section 56. The housing 50 is preferably made of a material that is resistant to chemicals and water, such as a polymeric material. Referring to FIGS. 6*a*-6*c*, the first section 54 of the body 52 is preferably tubular shaped and includes a first closed end 58 and a second open end 60. The first section 54 of the body 52 defines a plurality of openings 62, 62', wherein the ultrasound generating source (not shown) can transmit ultrasound waves passing through the opening 62, and an ultrasound detector (not shown) can receive ultrasound transmissions passing through opening 62', thus detecting a user at the toilet. Alternatively, openings 62 and 62' can be an infrared transmitter and receiver, respectively. Infrared transmitters and receivers are well known in the art.

Referring to FIGS. 7*a*-7*d*, the second section 56 of the body 52 of the sensor housing 50 is preferably annular shaped and includes an attached member 64 extending therefrom. The second section 56 of the body 52 is adapted to rotatably fasten to the second open end 60 of the first section 54 of the body 52 of the sensor housing 50. The member 64 defining a center passageway 66 (shown in FIGS. 7*b*-7*d*) is adapted to mount in the flush handle hole of a conventional toilet in a way that is similar to the way a manual flush handle is mounted to a toilet (shown in FIG. 1). Referring to FIG. 1, the sensor 14 can be mounted into the flush handle hole of the toilet T, via a nut N threadably fastened to a threaded portion of the member 64. The sensor 14 is electrically connected to the motor 20 in the actuator box 16 via the wire W passing through the center passageway 66 of the member 64 and sandwiched between the first cover 36 and actuator box 16 as shown in FIG. 1. The wire W should be thin enough to allow the first cover 36 to seal properly, thus preventing moisture from entering the actuator box 16. However, grommets or other types of seals or sealants can be used for the wire W to pass through the actuator box 16.

Figure 8:
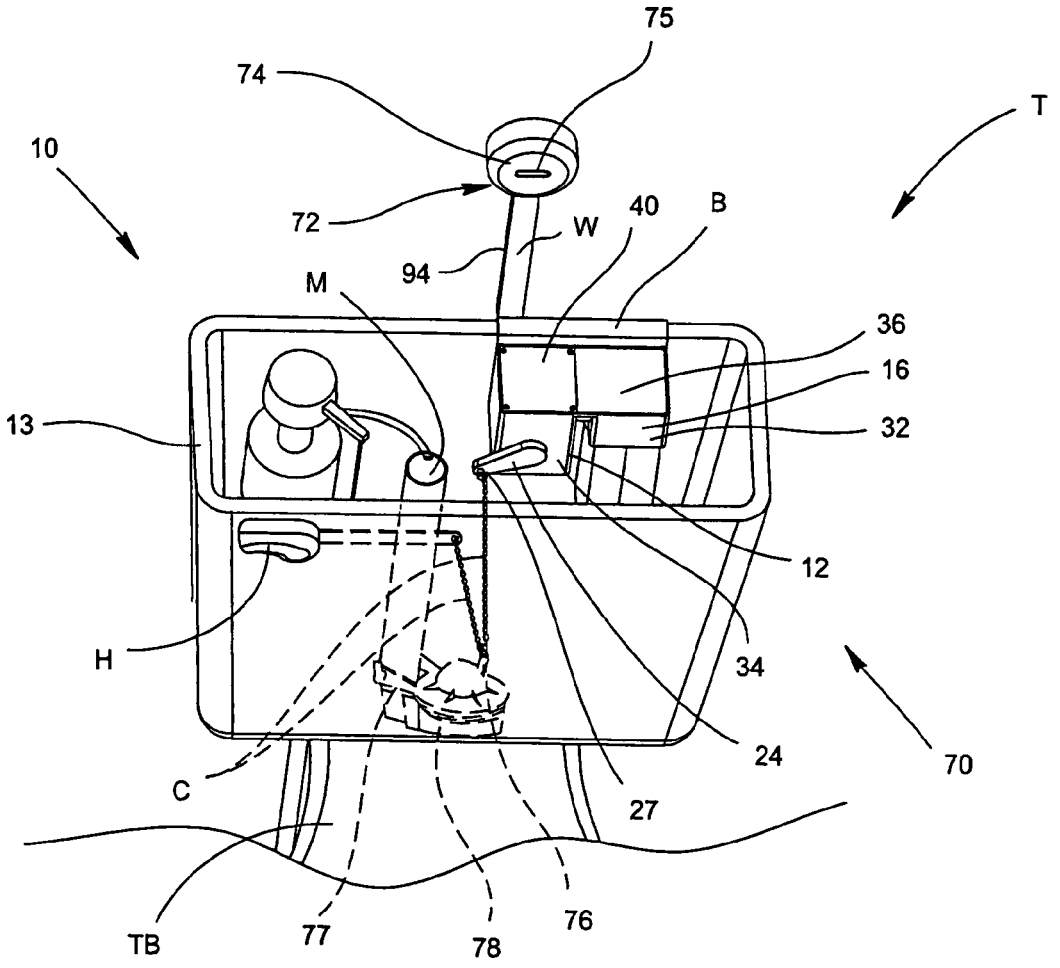
FIG. 8 is a perspective view illustrating a second embodiment of the invention of the automatic flushing system of the invention wherein the sensor arrangement is mounted to the wall above a conventional toilet and the actuator is mounted to a rim of the reservoir tank of a conventional toilet.

FIG. 8 shows a second embodiment of an automatic toilet flushing system 70 that is similar to automatic flushing system 10. As shown in FIG. 8, a sensor 72 includes a sensor housing 74 and a sensor element 75. The sensor element 75 can be an infrared sensor that is well known in the art to detect the presence of a user. Sensor housing 74 preferably is mounted on a wall in close proximity to actuator 12. However, it can be appreciated that sensor housing 72 may be located anywhere in the bathroom as long as it can detect a user near the toilet. The sensor housing 74 can house all of the internal components of sensor 14 including a transmitter for wireless communication (not shown), thereby eliminating the need for a physical connection, such as a wire W between the sensor 72 and the actuator 12. For wireless communication, the transmitter can transmit a signal from the sensor 72 to a signal transmission receiver (not shown) in the actuator box 16, for example, by radio frequency transmissions. The sensor housing 74 can be attached to a wall or an object using mechanical fasteners, adhesive tape or other means known in the art. The wire W can use male/female connectors to the sensor 72 and the actuator 16.

In a conventional toilet T with which the automatic flushing system 10 and 70 may be used, the toilet T comprises a toilet bowl TB and a reservoir tank 13 (also referred to as a water chest) located immediately rearwardly of and above the toilet bowl as best shown in FIG. 1. In this way, water is allowed to drain from the reservoir tank 13 by the force of gravity directly into the toilet bowl through conventional plumbing connections. Referring particularly to FIG. 8, the toilet T is generally provided with the flush handle H normally located on the side of the reservoir tank 13 and which operates a flushing mechanism M located within the reservoir tank 13. As particularly shown in FIG. 4, this flushing mechanism M typically includes a flapper valve 76 which is located at the lower end of the reservoir tank 13 and which can be opened and closed with respect to a water outlet 78 covered by the flapper valve 76 for releasing water into the toilet bowl. In conventional toilets having a manual flush handle H (FIG. 8), a second bead chain 77 (shown in FIG. 4) is generally used to connect the flapper valve 76 to the flush handle H. In an embodiment of the invention, the manual flush handle is replaced with the sensor 14 of the automatic flushing system 10. Referring to FIGS. 1 and 8, the actuator 12 is mounted to a ledge of the reservoir tank 13 via a bracket B, and the chain C connects the actuator 12 to the flapper valve 76 (shown best in FIG. 4). As shown best in FIG. 4, one end of the chain C is connected to the handle swivel HS on the external arm 24 and the opposite end of the chain C is connected to the flapper valve 76.

As discussed hereinabove, the sensor 14 of the embodiment of FIGS. 1, 6*a*-6*c*, and 7*a*-7*d* is designed so that sensor housing 50 is mounted in an opening of the reservoir tank 13 which generally receives a manually operated flush handle. The sensor housing 50 is designed to accommodate various tank designs in the market, such as front handle, side handle and 45° handle designs. The first section 54 of the body 52 of the sensor housing 50 can be adjusted by rotating the openings 62, 62' to a position for optimum user detection.

Figure 4:
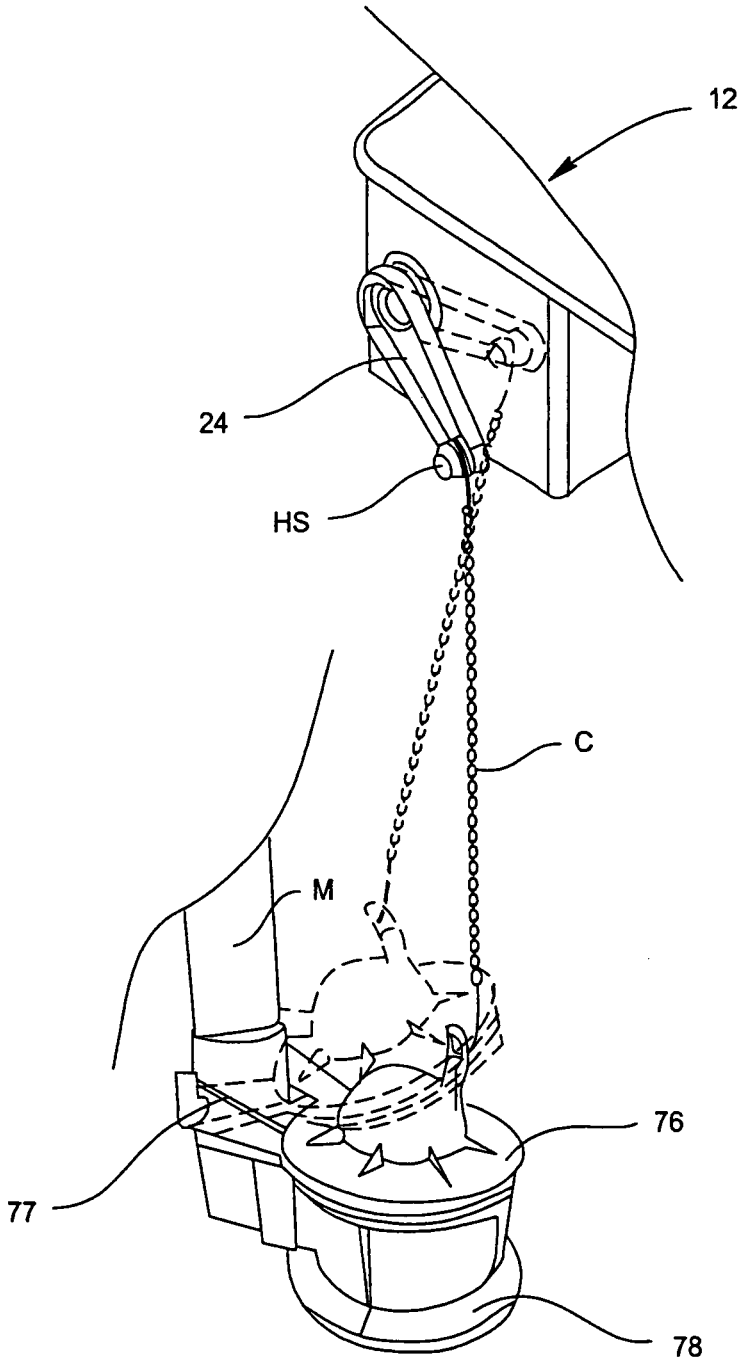
FIG. 4 is a perspective view showing an external rotating arm of the actuator and its mechanical connection to a flapper valve via a bead chain shown in FIG. 1.

In operation, the sensor 14 transmits a signal, such as ultrasound waves or infrared signals, through opening 62 of the sensor housing 50 within a vicinity of a toilet area. When a person comes within range of the toilet T, the signal is reflected by the body of the person and a receiver (not shown), such as an ultrasound receiver or infrared receiver, will receive a modulated signal through opening 62' thus detecting the presence of the person. The sensor 14 relays this signal to the actuator 12 via wire W or via wireless transmissions, such as radio frequency transmissions. A delay circuit which delays the signal for a predetermined time can be used to ensure that there is a person using the toilet T, and not just passing by. When the person finishes and leaves the toilet area, a modulated signal is not received by the receiver, thus indicating that no person is present. When this occurs, the motor 20 is activated and rotates the gear train 18, the rotation of which will rotate shaft 26 of pivotal arm 24. When pivotal arm 24 rotates, the tab 27 (FIG. 1) or the handle swivel HS (FIG. 2) on the end of pivotal arm 24 pivotally moves from a first position to a second position to open the flapper valve 76 as shown in phantom in FIG. 4. The motor 20 stops when the tab 27 or handle swivel HS reaches the second position. Referring to FIG. 4, the water then flows out from the reservoir tank 13 into the outlet 78, thereby flushing the toilet T. After a certain predetermined period of time, the motor 20 is activated and moves in a reverse direction pivotally moving the pivotal arm 24 from the second position back to the first position, thus closing the flapper valve 76. A timer (not shown) can be used to determine the flush time, which corresponds to the amount of water used for flushing the toilet T.

Referring again to FIG. 8, sensor 72 can detect the presence of a person approaching the toilet. Sensor 72 also preferably uses infrared technology, but can use any other technology, such as magnetic, electrostatic, ultrasonic and electromagnetic principles, for detection of a person in the vicinity of the sensor 72. As discussed hereinabove, the sensor 72 is in communication with the actuator 12 via an electrical connector W or via radio frequency transmissions or infrared transmissions (not shown). As shown in FIG. 8, the connector W can be partially covered with a cover 94, such as a channel, to hide the connector W. Sensor 72 includes housing 74 that is disc-shaped, wherein the housing 74 is preferably mounted above the reservoir tank 13. The sensor housing 74 can have a geometric-shaped window, such as rectangular shaped, as shown in FIG. 8, or circular shaped, not shown. Also, even though not shown, the sensor housing 74 may be rectangular shaped with a rectangular-shaped or circular-shaped window for the sensing detectors. The sensor 72 can be mounted to a wall or an object using mechanical fasteners, adhesive tape or other means known in the art.

The automatic flushing system 70 of FIG. 8 operates in a similar manner to automatic flushing system 10 of FIG. 1; however, the actuator 14 of FIG. 1 does not replace the existing manual flush handle H of a conventional toilet T, thereby allowing optional manual flushing of the toilet T as well as automatic flushing. In this embodiment, the flush handle H would also be connected to the flapper valve 76 preferably via the second bead chain 77 as shown in phantom in FIG. 4. It is to be appreciated the actuator 12 in the automatic flushing system 70 is similar to the automatic flushing system 10 of FIGS. 1.

Referring to FIGS. 1-8, a further embodiment relates to a method of converting a manual toilet flushing system into an automatic toilet flushing system 10, 70. This method involves the steps of providing sensor 14 for sensing the approach and departure motion of a user with respect to the toilet T and for generating a signal representative of the approach and departure motion of the user; providing actuator 12 in communication with the sensor 14, 72 for causing an automatic flushing of the toilet in response to the signal from the sensor 14, 72, the actuator 12 having a driven pivotal arm 24; and providing a flushing mechanism co-acting with the actuator 12, wherein the flushing mechanism 10 includes a flapper valve 76 adapted to release water from the reservoir tank 13, and wherein the pivotal arm 24 of the actuator 12 being connected to the flapper valve 76 for operation of the flapper valve upon the pivotal movement of the pivotal arm. In this method, the handle swivel HS is provided on the end of the pivotal arm 24 and a connector member, e.g., chain C is provided and connects the handle swivel HS to the flapper valve 76. Alternatively, the method also involves providing a tab 27 on the end of the pivotal arm 24, and a connector member, e.g., chain C is provided and connects the tab to the flapper valve 76. The steps further include providing a first sensor 50 (FIG. 1) configured to be inserted into an opening in the sidewall of the reservoir tank 13 to replace the manually operated handle or providing a second sensor 72 (FIG. 8) configured to be in close proximity to the reservoir tank 13 for optional operation of the flush handle H. The steps still further include providing a bracket B on the actuator 12, and mounting the actuator 12 inside the reservoir tank 13 by securing the bracket B to the reservoir tank 13.

Still referring to FIGS. 1-8, a related kit is also provided for converting a manually operated toilet flushing system into an automatic toilet flushing system 10 in a toilet T having a reservoir tank 13 and a toilet bowl TB. The kit includes a sensor 14, 72 for sensing the approach and departure motion of a user with respect to the toilet T and for generating a signal representative of the approach and departure motion of the user; an actuator 12 in communication with the sensor for causing an automatic flushing of the toilet in response to the signal from the sensor, the actuator having a driven pivotal arm; and a flushing mechanism co-acting with the actuator 12, the flushing mechanism including a flapper valve 76 adapted to release water from the reservoir tank 13, and the pivotal arm 24 of the actuator 12 being connected to the flapper valve 76 for operation of the flapper valve 76 upon the pivotal movement of the pivotal arm 24. The kit may include a handle swivel HS for mounting to the pivotal arm 24 and a connector member, e.g., chain C for connecting the handle swivel HS to the flapper valve 76. Alternately, the kit may include a tab 27 (FIG. 1) mounted at the end of the pivotal arm 24 and a connector member, e.g., chain C for connecting the tab 27 to the flapper valve 76. The kit may also include a bracket B for easily attaching the actuator 12 inside the reservoir tank 13 as shown in FIG. 3, a first sensor 50 configured to be inserted into an opening in the sidewall of the reservoir tank to replace the manually operated handle (FIG. 1); and a second sensor 72 configured to be in close proximity to the reservoir tank for optional operation of the manually operated handle H (FIG. 8).

It will be readily appreciated by those skilled in the art that modifications may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. An automatic toilet flushing system and a toilet, the toilet having a reservoir tank and a toilet bowl, the system comprising:

a sensor for sensing the approach and departure motion of a user with respect to the toilet and for generating a signal representative of the approach and departure motion of the user;

an actuator in communication with the sensor for causing an automatic flushing of the toilet in response to the signal from the sensor, the actuator comprising:

a driven pivotal arm;

a gear train;

a motor having a first output shaft rotatably connected to the gear train;

a second shaft pivotally connected to the gear train and to the pivotal arm of the actuator; and a power source for activating the motor and for rotating the first output shaft of the motor which rotates the gear train for the pivotal movement of the pivotal arm; and a flushing mechanism co-acting with the actuator, wherein the flushing mechanism includes a flapper valve adapted to release water from the reservoir tank, wherein the pivotal arm of the actuator is connected to the flapper valve for operation of the flapper valve upon the pivotal movement of the pivotal arm, and wherein said actuator further includes an actuator box for housing the actuator and wherein the actuator box comprises:

a first compartment for supporting the power source, a second compartment for supporting the gear train and the motor, wherein the second compartment is separate from the first compartment, a first cover for covering and sealing the first compartment, having a first edge a second cover for covering and sealing the second compartment, having a second edge wherein the second cover is separate from the first cover, and where the first edge is only adjacent to the second edge, a first sealing member inserted between the first cover and the first compartment for sealing the first compartment, a second sealing member inserted between the second cover and the second compartment for sealing the second compartment, and wherein the first compartment and the first cover fully enclose the power source and wherein the second compartment and the second cover fully enclose the gear train and the motor.

2. The automatic toilet flushing system of claim 1 wherein the pivotal arm includes a handle swivel and a connector member for connecting the handle swivel to the flapper valve.

3. The automatic toilet flushing system of claim 2 wherein the connector member is a chain.

4. The automatic toilet flushing system of claim 1 wherein the pivotal arm includes a tab and a connector member for connecting the tab to the flapper valve.

5. The automatic toilet flushing system of claim 4 wherein the connector member is a chain.

6. The automatic toilet flushing system of claim 1 wherein the power source includes at least one battery.

7. The automatic toilet flushing system of claim 1 wherein the power source includes a battery pack.

8. The automatic toilet flushing system of claim 1 wherein the power source includes a signal transmission receiver in communication with the sensor and the motor for receiving transmitted signals from the sensor for operation of the motor.

9. The automatic toilet flushing system of claim 1 wherein the actuator box has an opening in the sidewall of the second compartment, and wherein the shaft of the pivotal arm of the actuator extends through the opening in the sidewall of the second compartment for supporting the pivotal arm outside of the actuator box and for the pivotal movement of the pivotal arm along the sidewall of the second compartment for the operation of the flapper valve.

10. The automatic toilet flushing system of claim 1 wherein the actuator further includes a bracket member for mounting the actuator inside the reservoir tank of the toilet.

11. The automatic toilet flushing system of claim 1 wherein the reservoir tank has a sidewall and an opening in the sidewall; and wherein the sensor is configured to be supported in the opening in the sidewall of the reservoir tank.

12. The automatic toilet flushing system of claim 11 wherein the sensor comprises:

a housing having a body defining a first section and a second section;

the first section having a first closed end, a second open end, and a first opening and a second opening;

the first opening of the first section having a signal generating source for transmitting a signal through the first opening; and the second opening of the first section having a signal detector for receiving the transmitted signal from the signal generating source in the first opening thereby detecting the presence of a user of the toilet.

13. The automatic toilet flushing system of claim 12 wherein the second section of the housing of the sensor is configured to be secured to the second open end of the first section of the body, and wherein the second section of the body of the housing includes an extended member that defines a center passageway and is configured to be mounted in the opening in the sidewall of the reservoir tank of the toilet, and wherein the automatic toilet flushing system further includes an electrical connection extending through the center passageway of the extended member for electrically connecting the sensor to the actuator.

14. The automatic toilet flushing system of claim 1 wherein the sensor arrangement includes a disc-shaped housing and is configured to be mounted in close proximity to the reservoir tank, wherein the actuator is configured to be mounted in the reservoir tank.

15. The automatic toilet flushing system of claim 1, wherein the reservoir tank further includes a manual flushing mechanism, whereby the toilet may optionally be flushed by the automatic toilet flushing system or by the manual flushing mechanism.

16. A kit for converting a manually operated toilet flushing system into an automatic toilet flushing system in a toilet having a reservoir tank and a toilet bowl, the kit comprising:

a sensor for sensing the approach and departure motion of a user with respect to the toilet and for generating a signal representative of the approach and departure motion of the user;

an actuator in communication with the sensor for causing an automatic flushing of the toilet in response to the signal from the sensor, the actuator comprising:

a driven pivotal arm;

a gear train;

a motor having a first output shaft rotatably connected to the gear train;

a second shaft pivotally connected to the gear train and to the pivotal arm of the actuator; and a power source for activating the motor and for rotating the first output shaft of the motor which rotates the gear train for the pivotal movement of the pivotal arm; and a flushing mechanism co-acting with the actuator, the flushing mechanism including a flapper valve adapted to release water from the reservoir tank, and the pivotal arm of the actuator being connected to the flapper valve for operation of the flapper valve upon the pivotal movement of the pivotal arm, wherein said actuator further includes an actuator box for housing the actuator and wherein the actuator box comprises:

a first compartment for supporting the power source, a second compartment for supporting the gear train and the motor, wherein the second compartment is separate from the first compartment, a first cover for covering and sealing the first compartment, having a first edge a second cover for covering and sealing the second compartment, having a second edge wherein the second cover is separate from the first cover, and where the first edge is only adjacent to the second edge, a first sealing member inserted between the first cover and the first compartment for sealing the first compartment, a second sealing member inserted between the second cover and the second compartment for sealing the second compartment, and wherein the first compartment and the first cover fully enclose the power source and wherein the second compartment and the second cover fully enclose the gear train and the motor.

17. The kit of claim 16, further comprising a handle swivel for mounting to the pivotal arm and a connector member for connecting the handle swivel to the flapper valve.

18. The kit of claim 17 wherein the connector member is a chain.

19. The kit of claim 16 further comprising a tab for mounting to the pivotal aim and a connector member for connecting the tab to the flapper valve.

20. The kit of claim 19 wherein the connector member is a chain.

21. The kit of claim 16 further including a bracket attached to the actuator for mounting the actuator inside the reservoir tank.

22. The kit of claim 16 further including a first sensor configured to be inserted into an opening in the sidewall of the reservoir tank.

23. The kit of claim 22 further including a second sensor configured to be in close proximity to the reservoir tank.

24. A method of converting a manual toilet flushing system into an automatic toilet flushing system, the steps comprising:

providing a sensor for sensing the approach and departure motion of a user with respect to the toilet and for generating a signal representative of the approach and departure motion of the user;

providing an actuator in communication with the sensor for causing an automatic flushing of the toilet in response to the signal from the sensor, the actuator comprising:

a driven pivotal arm;

a gear train;

a motor having a first output shaft rotatably connected to the gear train;

a second shaft pivotally connected to the gear train and to the pivotal arm of the actuator; and a power source for activating the motor and for rotating the first output shaft of the motor which rotates the gear train for the pivotal movement of the pivotal arm; and providing a flushing mechanism co-acting with the actuator, wherein the flushing mechanism includes a flapper valve adapted to release water from the reservoir tank, wherein the pivotal arm of the actuator is connected to the flapper valve for operation of the flapper valve upon the pivotal movement of the pivotal arm, and wherein said actuator further includes an actuator box for housing the actuator and wherein the actuator box comprises:

a first compartment for supporting the power source, a second compartment for supporting the gear train and the motor, wherein the second compartment is separate from the first compartment, a first cover for covering and sealing the first compartment, having a first edge a second cover for covering and sealing the second compartment, having a second edge wherein the second cover is separate from the first cover, and where the first edge is only adjacent to the second edge, a first sealing member inserted between the first cover and the first compartment for sealing the first compartment, a second sealing member inserted between the second cover and the second compartment for sealing the second compartment, and wherein the first compartment and the first cover fully enclose the power source and wherein the second compartment and the second cover fully enclose the gear train and the motor.

25. The method of claim 24, the steps further comprising providing a handle swivel on the end of the pivotal arm and connecting a connector member to the handle swivel and to the flapper valve.

26. The method of claim 25 wherein the connector member is a chain.

27. The method of claim 24, the steps further comprising providing a tab on the end of the pivotal arm, and connecting a connector member to the tab and to the flapper valve.

28. The method of claim 27 wherein the connector member is a chain.

29. The method of claim 24, the steps further comprising providing a first sensor configured to be inserted into an opening in the sidewall of the reservoir tank to replace the manually operated handle.

30. The method of claim 24, the steps further comprising providing a second sensor configured to be in close proximity to the reservoir tank for optional operation of the manually operated handle.

31. The method of claim 24, the steps further comprising providing a bracket on the actuator, and mounting the actuator inside the reservoir tank by securing the bracket to the reservoir tank.

* * * * *

UNITED STATES PATENT AND TRADEMARK OFFICE

CERTIFICATE OF CORRECTION

PATENT NO. : 8,695,125 B2
APPLICATION NO. : 11/789034
DATED : April 15, 2014
INVENTOR(S) : Michael A. Funari It is certified that error appears in the above-identified patent and that said Letters Patent is hereby corrected as shown below:

In the Claims

Column 12, Line 14, Claim 19, delete “aim” and insert -- arm --

Signed and Sealed this
Fifth Day of August, 2014

Michelle K. Lee

Michelle K. Lee
*Deputy Director of the United States Patent and Trademark Office*